US006997772B2

(12) United States Patent
Fong

(10) Patent No.: US 6,997,772 B2
(45) Date of Patent: Feb. 14, 2006

(54) INTERACTIVE DEVICE LED DISPLAY

(76) Inventor: Peter Sui Lun Fong, 297F S. Atlantic Blvd., Monterey Park, CA (US) 91754

( * ) Notice: Subject to any disclaimer, the term of this patent is extended or adjusted under 35 U.S.C. 154(b) by 0 days.

(21) Appl. No.: 10/264,797

(22) Filed: Oct. 4, 2002

(65) Prior Publication Data

US 2004/0067713 A1 Apr. 8, 2004

(51) Int. Cl.
*A63H 30/00* (2006.01)

(52) U.S. Cl. ..... 446/175

(58) Field of Classification Search ..... 446/72, 446/81, 85, 175, 183–184, 188, 219, 221, 446/268, 270, 297, 308, 485, 488; 340/815.45, 340/815.46, 815.49, 815.55, 815.56, 815.73
See application file for complete search history.

(56) References Cited

U.S. PATENT DOCUMENTS 5,791,965 A * 8/1998 Kim ..... 446/219
5,971,827 A * 10/1999 Lee et al. ..... 446/81
6,074,212 A * 6/2000 Cogliano ..... 434/159
6,116,753 A * 9/2000 Tsang ..... 362/253
6,253,058 B1 * 6/2001 Murasaki et al. ..... 434/308
6,404,131 B1 * 6/2002 Kawano et al. ..... 315/82
2003/0214259 A9 * 11/2003 Dowling et al. ..... 315/312

* cited by examiner

*Primary Examiner*—Kim Nguyen
(74) *Attorney, Agent, or Firm*—Stetina Brunda; Garred & Brucker

(57) ABSTRACT

An interactive soft toy with a light emitting diode device mounted within the soft toy. The light emitting diode device has a translucent front cover and translucent sheet to which a graphic pattern is applied. The light emitting diode device is operative to display a pattern. When the pattern of the light emitting diode panel is illuminated, the graphic pattern is overshadowed thereby. The on/off status of the light emitting diode units can be controlled by a manual input device, an infrared signal, or an audio signal. The light emitting diode device further has a speaker for generating a sound effect corresponding to the pattern displayed by the light emitting diode device.

34 Claims, 6 Drawing Sheets

INTERACTIVE DEVICE LED DISPLAY

CROSS-REFERENCE TO RELATED APPLICATIONS (Not applicable)

STATEMENT RE: FEDERALLY SPONSORED RESEARCH/DEVELOPMENT (Not applicable)

BACKGROUND OF THE INVENTION

The present invention relates generally to an interactive device with a light emitting diode device and, more particularly, to a toy with a multi-functional LED device.

Among various kinds of toys available in the market, educational toys are particularly popular for young children, whose brains are continuously and rapidly developing. The inclusion of educational tools within soft or stuffed toys facilitates learning by allowing a child to learn in an informal, relaxed manner, i.e., by playing with a toy. For example, young children can easily remember the letters appearing on their favorite soft toys. However, the educational value of such soft toys is limited due to the letters thereon appearing solely in a stationary pattern.

SUMMARY OF THE INVENTION

The present invention provides an interactive device (e.g., a soft toy) including a light emitting diode (LED) device. The LED device is mounted within or on a portion of the soft toy and comprises a plurality of light emitting diode units arranged as an array. Each of the light emitting diode units can be activated individually and in any combination under various operation modes, such that the combination of lit and unlit light emitting diode units presents a particular pattern (e.g., a picture of an object, a number, a letter, or a simple word) for an educational purpose, simply to provide a visual effect, for the display of an alarm clock or a timer. In addition to the simple pattern, by controlling the light intensity and flashing rates of the light emitting diode units, special image effects such as motion and dimension effects can be obtained. Further, each of the light emitting diode units is operative to emit a monochromatic light or a multi-color light, depending on the amount and variety of the light emitting diode dies included therein.

The LED device further comprises a translucent front cover through which the illuminated pattern of the LED device is observable, a translucent sheet attached to the front cover, and a rear cover. A graphic pattern may be printed lightly on the front cover or, alternatively, on the translucent sheet. When the LED device is switched off, the graphic pattern is visible. However, the graphic pattern is printed so lightly that when the LED device is activated, the high contrast between the graphic pattern and the light emitting diode makes the graphic pattern relatively invisible. Sequentially arranged between the translucent front cover and the rear cover are the translucent sheet, a curved light emitting diode guide, a printed circuit board, and a spacer disposed on the printed circuit board. The spacer supports the light emitting diodes such that the light emitted by each of the light emitting diodes has a substantially identical optical path length. The printed circuit board of the LED device further comprises a circuit printed thereon in electrical communication with and operative to selectively activate the light emitting diode units.

The soft toy may comprise one or more mechanisms for activating the LED device. For example, the soft toy may comprise a manual input device (e.g., an external switch, an external key pad or an external button) in electrical communication with the circuit and operative to selectively activate the LED device. Alternatively, the LED device may be activated by an infrared signal or by another source such as a sound signal.

The LED device may further comprise a speaker operative to produce an audio effect. For example, when a particular pattern is displayed by the light emitting diode device, a sound corresponding thereto may be generated simultaneously, thus teaching a small child both the name and appearance of the object, letter, number, or word depicted by the pattern.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
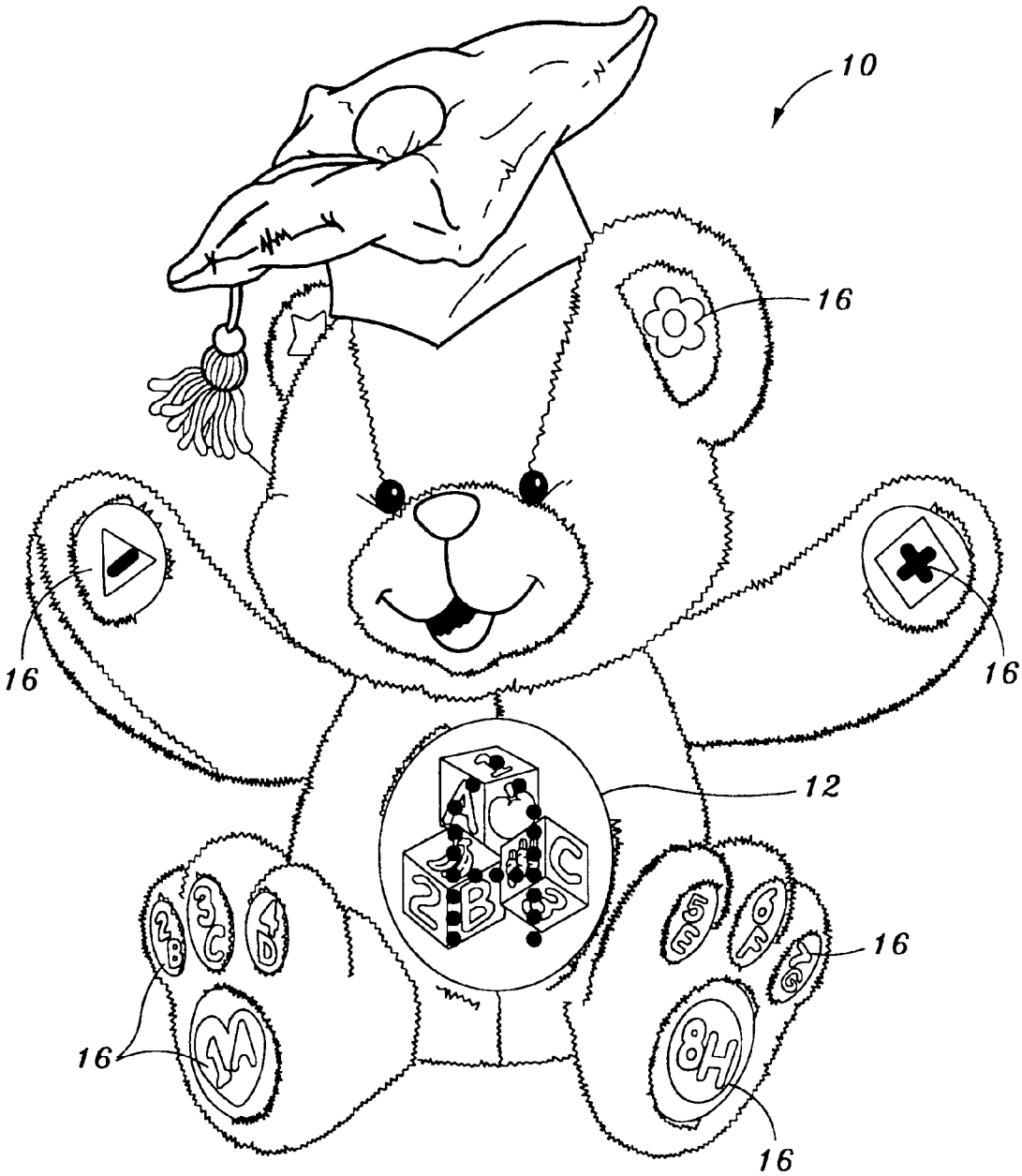
FIG. 1 is a perspective view of an interactive soft toy constructed in accordance with the present invention, the light emitting diode (LED) device thereof displaying an exemplary pattern.
Figure 2:
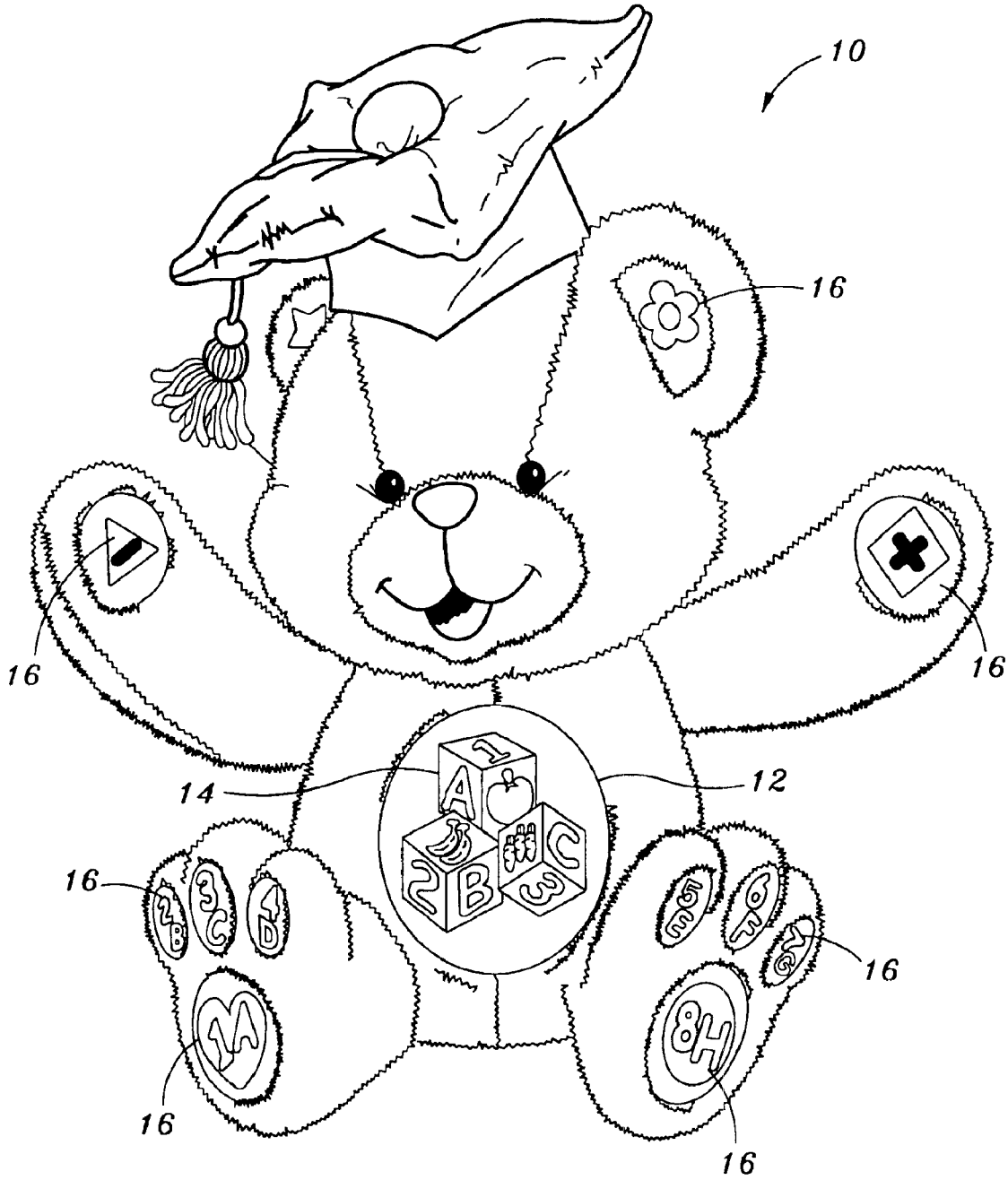
FIG. 2 is a perspective view of the toy as shown in FIG. 1, with the LED device switched off.
Figure 3:
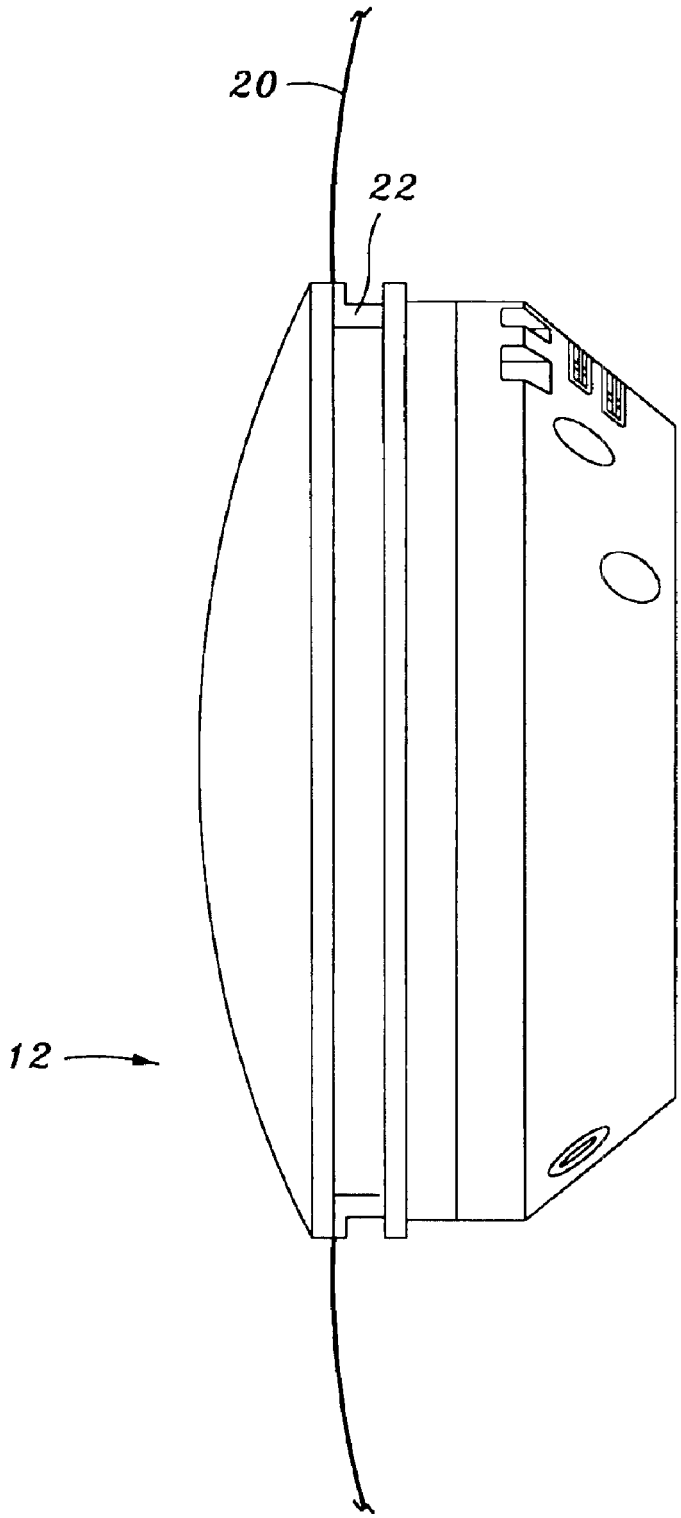
FIG. 3 shows a side view of the LED device mounted to the toy.

Referring now to the drawings wherein the showings are for purposes of illustrating preferred embodiments of the present invention only, and not for purposes of limiting the same, FIGS. 1 and 2 perspectively illustrate a toy 10 comprising a light emitting diode (LED) device 12, and FIG. 3 shows the way the LED device 12 is mounted to the toy 10. The toy 10 includes a soft toy such as a plush toy animal, a stuffed fabric toy figure, a fabric doll or a plastic doll with a stuffed body. As shown in FIGS. 1 and 2, the toy 10 further comprises a plurality of switches 16 allowing the user to manually activate the LED device 12. Preferably, the switches 16 are embedded in various parts of the toy, such as the ears, palms, feet, and toes, which are accessible to the user. In FIG. 3, the outer material 20 (e.g., a fabric or a plush material) of the toy 10 has an opening with a contractable loop or sleeve 22 formed at the edge thereof. A wire, string or cord made of bendable, sturdy and durable material such as a nylon cable tie, a bendable metal wire, a plastic strip or a cord is inserted through the loop. As shown in FIG. 3, when a light emitting diode (LED) device 12 is inserted across the opening, the loop 22 is contracted by fastening the nylon cable tie, such that the LED device can be securely mounted to the toy 10.

Preferably, the LED device 12 is a multi-functional device that provides various functions under different operation modes. For example, in a simple display mode, the LED device 12 displays a specific image based on an activation signal to provide an educational or visual effect. The LED device 12 can also be used as an alarm clock to show the time and set up an alarm. Additionally, the LED device 12 can be used as a timer, with a display showing the timing.

Figure 4:
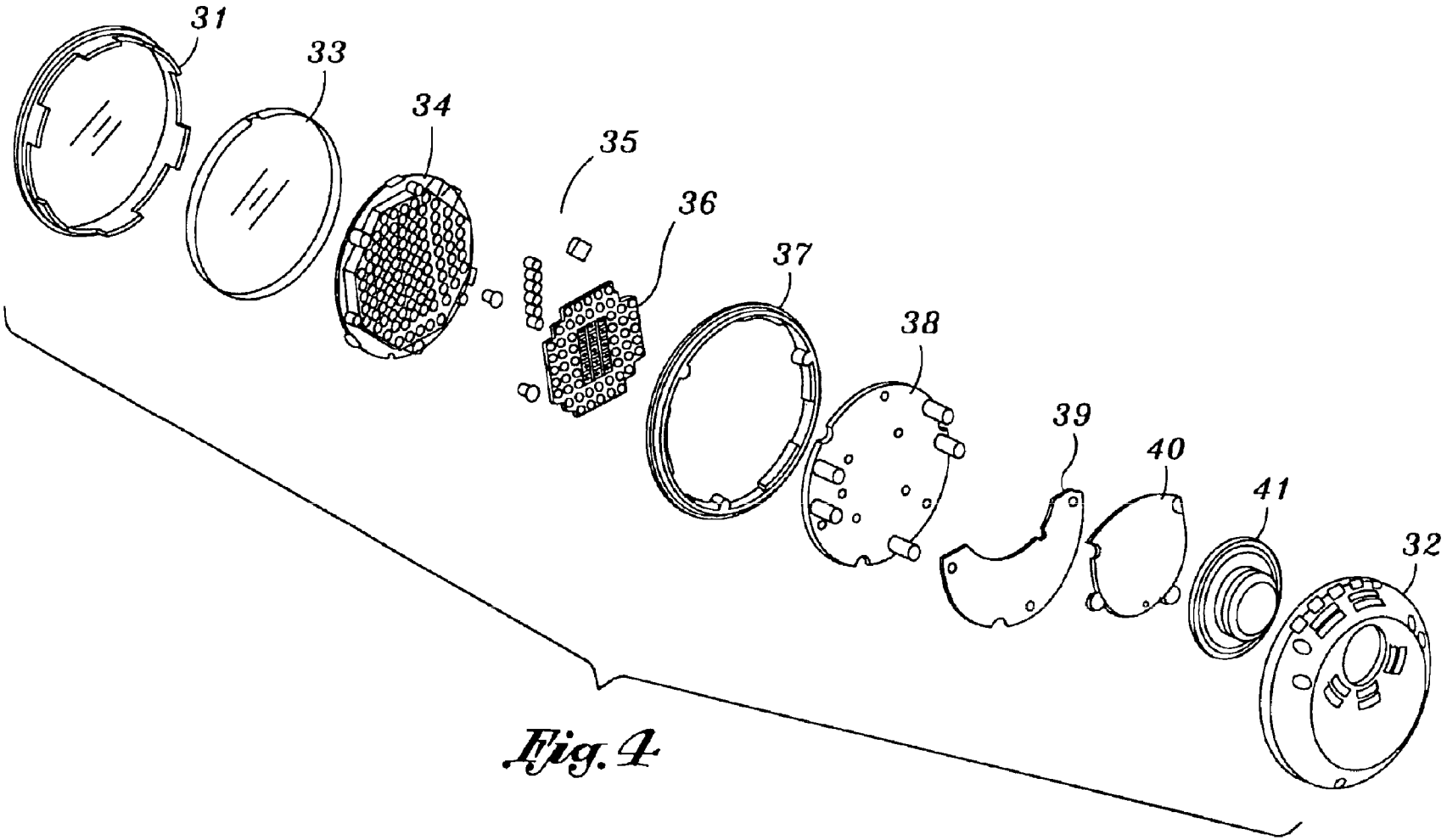
FIG. 4 shows an exploded view of the LED device.

FIG. 4 shows an exploded view of the LED device 12. The LED device 12 comprises a plurality of LED units 35 disposed in an LED guide 34 and arranged as an array. One or more LED dies, for example, one green LED die and one red LED die, can be used in one LED unit 35. Therefore, each LED unit 35 can emit a monochromatic light or multi-color light according to the number and variety of the LED dies therein. Each of the LED units 35 can be individually activated. By controlling the on/off status of each of the LED units 35, a particular pattern (e.g., a picture of an object, a number, a letter, and/or a simple word) can be displayed by the LED device 12, as described in more detail below. Further, the light intensity and flashing rate of the LED units 35 can also be controlled to obtain a special image effect such as a motion picture of a moving object. Typically, the LED guide 34 has a curved profile. A spacer 36 comprising several stages, each of a different height, enables each of the LED units 35 to be disposed so as to provide the light emitted therefrom with a substantially identical optical path length. As a result of the uniformity of the optical path length of the light emitted by each of the LED units 35, the LED device 12 can produce uniform brightness as required. Preferably, the LED device 12 also includes a speaker 41 and a speaker cover 40, the speaker 41 being operative to provide the toy 10 with sound effects.

Figure 6:
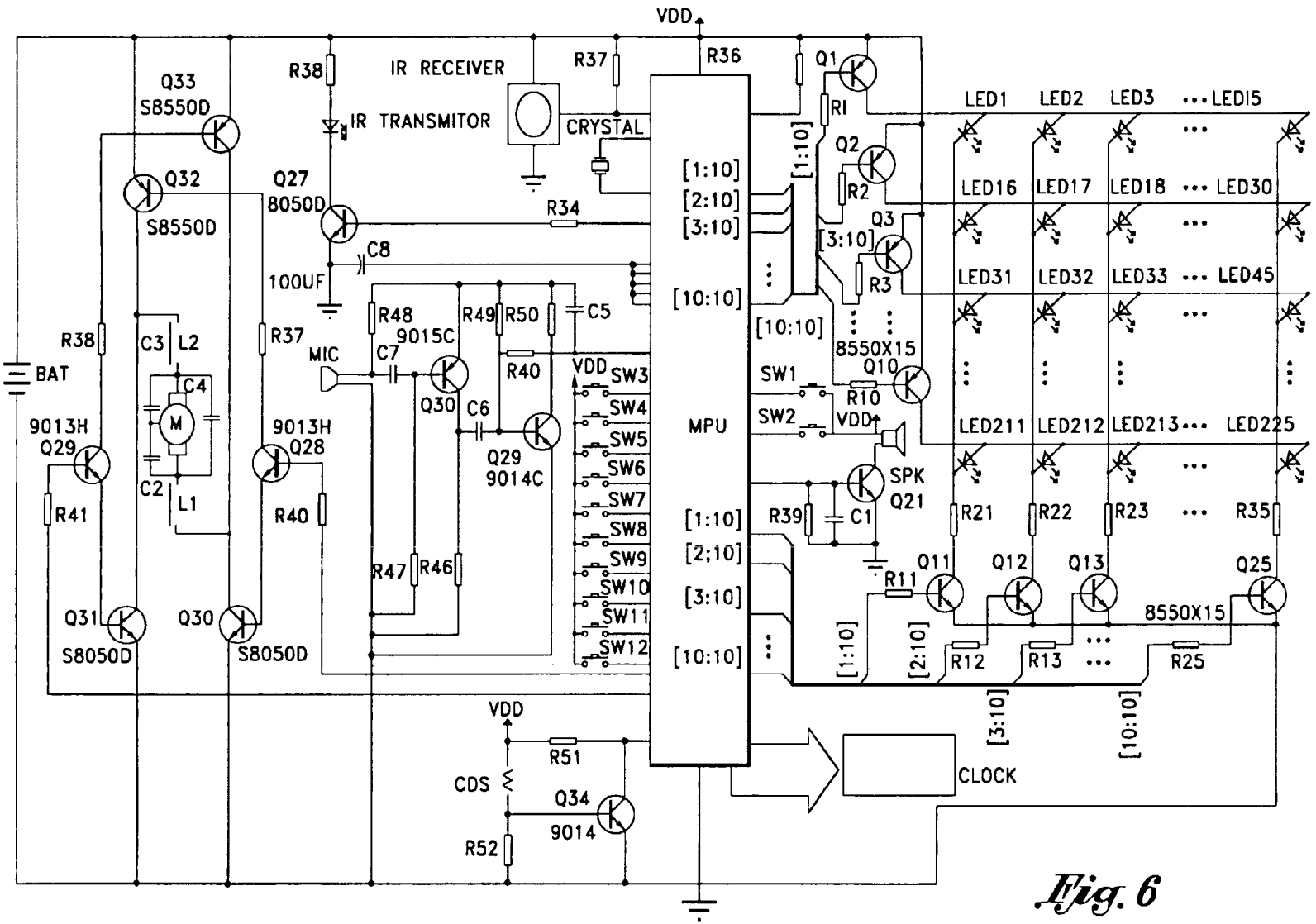
FIG. 6 is a schematic of electronic circuitry used for controlling the on/off status of the light emitting diodes of the LED device.

The LED device 12 further comprises a primed circuit board (PCB) 38 operative to structurally and/or functionally support the LED units 35 and a main PCB 39 operative to provide other electrical and/or optical functions. Printed on the circuit boards 38, 39 is a circuit having various components. As shown in FIG. 6, the circuit comprises a microprocessor MPU operative to control the operation of the LED units 35 (i.e., the on/off status of light emitting diode dies LED1 to LED225). For example, according to the signal from an internal or external switch device, the processor MPU controls the displayed effect of the LED units 35 according to the selected modes, including a simple display mode, an alarm clock mode, and a timer mode. The processor MPU can also be programmed to control the on/off timing, light intensity or brightness, and on/off frequency or flashing rate of the LED diode dies LED1 to LED225 to obtain a stationary pattern or an animated light pattern with the dimensional effect. The circuit further comprises a battery BAT in electrical communication with the components of the circuit and operative to provide power thereto. Access to the battery BAT may be provided so that the same can be replaced as necessary.

The alarm clock mode and the timer mode can be achieved by incorporating a crystal in the circuit as shown in FIG. 6. In addition, the circuit further comprises a light sensor such as a photo conductive cell CDS or a photodiode operative to detect the ambient brightness/darkness of the toy. When the ambient brightness is lower than a predetermined value, the LED device 12 is automatically lit up in response to the signal of the light sensor.

The LED device 12 further comprises a front cover 31 and a sheet of translucent or clear material 33 attached thereto. The front cover 31 is manufactured of a clear or translucent material such as plastic, and the sheet 33 is manufactured of a clear or translucent material such as polyvinyl chloride (PVC), polyethylene (PE), paper or fabric. The LED device 12 additionally includes a rear cover 32. A locking ring 37 is further included and engaged with the front cover 31. In this embodiment, the locking ring 37 is snapped with the front cover 31 when the front cover 31 is positioned at the opening of the outer material 20, and the translucent sheet 33 is placed between the front cover 31 and the locking ring 37. It is appreciated that other mechanisms can alternatively be applied to the engagement between the front cover 31 and the locking ring 37 without being restricted to a snapping mechanism. When the front cover 31 is engaged with the locking ring 37, the LED guide 34, LED units 35, spacer 36, PCB's 38 and 39, speaker cover 40, speaker 41, and rear cover 32 are then attached to the locking ring 37 at the opposing side of the front cover 31. For example, the components from the LED guide 34 to the rear cover 32 can be attached to the locking ring 37 via screws. Again, various locking mechanisms can be used for such attachment. A graphic pattern 14 may be printed on the front cover 31 or, alternatively, on the translucent sheet 33. The graphic pattern 14 printed on the translucent sheet 33 is preferred since the material thereof provides a better printing quality. The graphic pattern 14 may be printed using an offset printing, screen printing or a pad printing process. Preferably, the graphic pattern 14 is printed so lightly (e.g., by using translucent inks) that when the LED device 12 is activated, the high contrast between the illuminated pattern of the LED device 12 and the printed graphic pattern 14 causes the graphic pattern 14 to be relatively unobservable. In an exemplary embodiment, the graphic pattern 14 comprises a plurality of blocks each having a plurality of surfaces on which various symbols, letters and numbers are presented. Preferably, the translucent sheet 33 is manufactured of a translucent, rather than a transparent, material such that when the LED device 12 is switched off (i.e., when none of the LED units 35 is activated), the LED units 35 are not observable. Thus, the graphic pattern 14 is easily observable when the LED device 12 is switched off.

Figure 5:
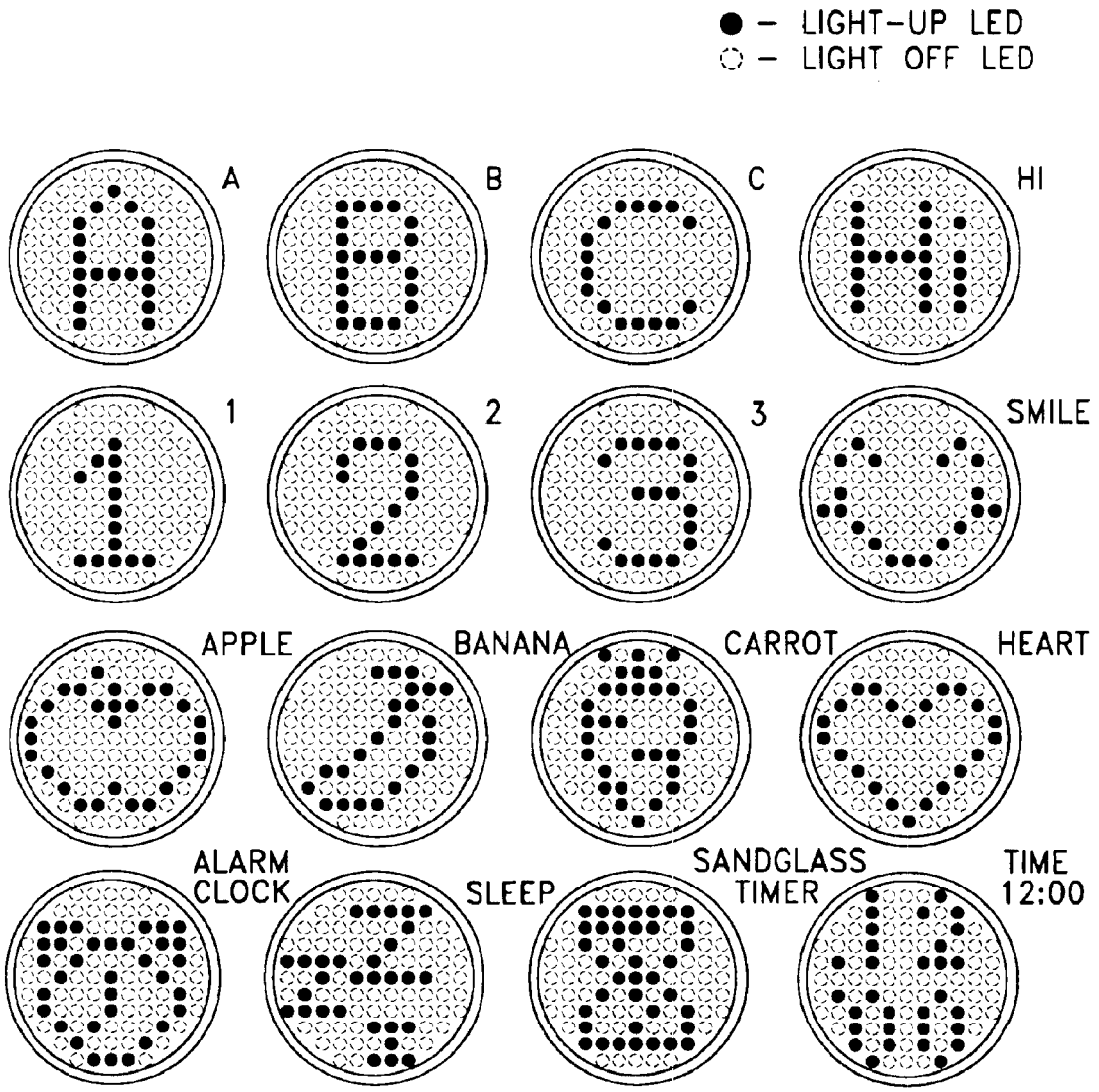
FIG. 5 shows examples of patterns displayed by the LED device.

The LED units 35 of the LED device 12 can be selectively activated so as to display any of a variety of patterns in various operation modes. FIG. 5 shows various examples of patterns displayable by the LED device 12. It should be understood that the patterns shown in FIG. 5 are exemplary only, and that alternative patterns can be designed to provide a specific visual and/or educational effect without departing from the spirit and scope of the present invention. In FIG. 5, the first three rows are examples of patterns displayed in response to an activation signal when the toy is set at a display mode . In the fourth row, patterns related to different modes of the toy are illustrated. For example, the first and second patterns displayed by the LED device 12 are a clock and snoozing symbols, which indicates that the toy is currently switched to an alarm clock mode. The third pattern in the fourth row shows a sand glass timer, which indicates the toy is switched to a timer mode, and the last pattern in the fourth row displays the time when the toy is switched to a clock mode. As mentioned above, in addition to the simple display mode under which various patterns are selectively displayed, the toy can further be operated as an alarm clock and a timer under various modes. When the alarm clock mode is selected, the display on the LED device 12 includes an alarm clock, a snoozing symbol or other patterns allowing the user to realize the current application of the toy. Similarly, in the timer mode or clock mode, different patterns can be generated.

The operation mode selection can be achieved by a manual switch, a remote control, or even an audio control. In the simple display mode, the LED device 12 of the toy provided by the present invention can be activated in various ways. The child may activate or inactivate the LED device 12 via an input device such as an external switch, an external key pad, an external button connected to the circuit, or one of the internal switches 16 embedded in the toy 10 and described above. The LED device 12 can alternatively be activated by an infrared (IR) signal. As shown in FIG. 6, the circuit comprises an IR transmitter and an IR receiver to provide this infrared communication function. The source of the infrared signal may include a remote control, another interactive toy, or even a broadcasting station that has a local infrared transmitter around the toy. Infrared activation and interaction with other devices is described in U.S. Pat. No. 6,309,275 entitled Interactive Talking Dolls issued Oct. 30, 2001, the disclosure of which is incorporated herein by reference.

Various patterns (e.g., a picture of an object, a number, a letter, and/or a simple word) can be provided for each of the switches 16. In this regard, a child can simply press the switch provided with a particular pattern to activate the LED device 12 to display the desired pattern. The child can select display of a single pattern or, alternatively, display of a plurality of patterns in sequence. The displayed pattern or sequence of patterns can be pre-programmed and saved.

In addition to the manual control and the remote infrared control, an audio control may also be applied to select the mode of the toy and activate the LED device 12. Various patterns may be programmed and saved corresponding to specific sound signals. For example, by inputting a pronunciation such as "A", "2" or "carrot" via a microphone MIC included in the circuit, the LED device 12 may display a visual pattern corresponding to the respective audio pattern. The speaker SPK which is included in the circuit may be activated synchronously with the LED device 12 such that when a particular visual pattern is displayed, the corresponding audio pattern is simultaneously presented to the child.

Additional modifications and improvements of the present invention may be apparent to those skilled in the art. Thus, the particular combination of parts described and illustrated herein is intended to represent only one embodiment of the present invention, and is not intended to serve as a limitation of alternative devices within the spirit and scope of the invention.

What is claimed is:

1. A soft toy, comprising:

a body portion; and a light emitting diode device, wherein the light emitting diode device further comprises:

a translucent front cover;

a printed circuit board;

a light emitting diode guide;

a plurality of light emitting diode units guided by the light emitting diode guide and operative to selectively generate an illuminated pattern;

a spacer disposed on the printed circuit board and supporting the light emitting diode units such that the light emitted from each of the light emitting diode units has a substantially identical optical path length to the translucent front cover; and a rear cover, wherein the light emitting diode guide, the light emitting diode units, the spacer, and the printed circuit board are sequentially arranged between the front cover and the rear cover.

2. The soft toy according to claim 1, wherein each light emitting diode unit comprises at least one light emitting diode die.

3. The soft toy according to claim 1, wherein at least one of the light emitting diode units comprises a plurality of color light emitting diode dies.

4. The soft toy according to claim 1, further comprising a circuit which is printed on the printed circuit board and in electrical communication with the light emitting diode units, the circuit being operative to selectively activate the light emitting diode units to display at least one of a plurality of preprogrammed illumination patterns in response to an activation signal.

5. The soft toy according to claim 4, further comprising a manual input device in electrical communication with the circuit and operative to selectively activate the light emitting diode units of the light emitting diode device.

6. The soft toy according to claim 4, wherein the circuit is configured to allow the light emitting diode units to be activated independently and in any combination.

7. The soft toy according to claim 6, wherein the circuit is operative to control brightness and flashing rate of each of the light emitting diode units independently.

8. The soft toy according to claim 4, wherein the circuit comprises an infrared receiver operative to receive an infrared signal.

9. The soft toy according to claim 8, wherein the circuit is configured to activate the light emitting diode units upon receipt of the infrared signal.

10. The soft toy according to claim 8, wherein the circuit comprises an infrared transmitter operative to transmit an infrared signal to activate another soft toy that comprises the infrared receiver.

11. The soft toy according to claim 4, wherein the circuit comprises a microphone operative to receive a sound signal.

12. The soft toy according to claim 11, wherein the circuit is configured to activate the light emitting diode device upon receipt of the sound signal.

13. The soft toy according to claim 4, wherein the circuit is configured to facilitate the display of a single pattern on the light emitting diode device.

14. The soft toy according to claim 4, wherein the circuit is configured to facilitate the display of a sequence of patterns on the light emitting diode device.

15. The soft toy according to claim 4, further comprising a speaker in electrical communication with the circuit and operative to produce a sound effect corresponding to the pattern displayed by the light emitting diode device.

16. The soft toy according to claim 1, wherein the light emitting diode device further comprises a translucent sheet between the front cover and the light emitting diode guide.

17. The soft toy according to claim 16, further comprising a graphic pattern printed on the translucent sheet.

18. The soft toy according to claim 17, wherein the graphic pattern comprises one of an offset printed pattern, a screen-printed pattern and a pad-printed pattern.

19. The soft toy according to claim 16, wherein the translucent sheet is manufactured from polyvinyl (PVC), polyethylene (PE), paper material or fabric material.

20. The soft toy according to claim 1, further comprising a graphic pattern printed on the light emitting diode device, wherein the graphic pattern is overshadowed by the illuminated pattern when the light emitting diode device is switched on.

21. The soft toy according to claim 1, further comprising a crystal providing timer and clock functions to the toy.

22. The soft toy according to claim 21, wherein the light emitting diode device is electrically connected to the crystal as a display for the timer and the clock functions.

23. The soft toy according to claim 1, further comprising a light sensor to automatically light up at least one of the light emitting diode units.

24. An interactive device, comprising:

a body portion, wherein the body portion has a perforation, a contractable loop along an edge of the perforation, and a fastening means inserted through the contractable loop; and a light emitting diode device, inserted into the perforation and secured by fastening the fastening means, wherein the light emitting diode device further comprises:

a plurality of light emitting diode units operative to illuminate any of a variety of patterns in response to an activation signal; and a circuit in electrical communication with the light emitting diode units and a speaker, the circuit being operative to control the pattern displayed by the light emitting diode device a sound generated by the speaker.

25. The device according to claim 24, further comprising a graphic pattern printed on the light emitting diode device.

26. The device according to claim 24, wherein the graphic pattern is overshadowed by the pattern illuminated by the light emitting diode units when the light emitting diode units are activated.

27. The device according to claim 24, wherein the circuit comprises a microphone operative to receive a sound signal.

28. The device according to claim 24, wherein the circuit is configured to activate the light emitting diode device upon the receipt of a sound signal.

29. The device according to claim 24, further comprising at least one input device attached to the body portion and accessible to a user, the input device being in electrical communication with the circuit.

30. The device according to claim 24, wherein the device includes a toy with a stuffed body.

31. The device according to claim 24, wherein the fastening means includes a nylon cable tie, a bendable metal wire, a plastic strip or a cord.

32. The device according to claim 24, wherein at least one of the light emitting diode units comprises a plurality of color light emitting diode dies.

33. The device according to claim 24, wherein the circuit is further operative to independently control light intensity and flashing rate of each light emitting diode unit.

34. The device according to claim 24, wherein the circuit further comprises a crystal allowing the light emitting diode device to be operated as an alarm clock, a timer, or a combination thereof.

* * * * *